United States Patent [19]

Fletcher et al.

[11] Patent Number: 4,487,024

[45] Date of Patent: Dec. 11, 1984

[54] THERMOELECTRIC ICE CUBE MAKER

[75] Inventors: Charles J. Fletcher, Sparta; Everett Moshier, Hamburg, both of N.J.

[73] Assignee: Clawson Machine Company, Inc., Franklin, N.J.

[21] Appl. No.: 475,822

[22] Filed: Mar. 16, 1983

[51] Int. Cl.[3] ..... F25B 21/02

[52] U.S. Cl. ..... 62/3; 62/344; 221/205

[58] Field of Search ..... 62/3, 344; 221/201, 221/205; 414/199, 200; 49/334, 394

[56] References Cited

U.S. PATENT DOCUMENTS

| | | | |
|---|---|---|---|
| 413,136 | 10/1889 | Dewey | 62/3 |
| 420,641 | 2/1890 | Dewey | 62/3 |
| 726,839 | 5/1903 | Arnold | 414/200 |
| 2,117,658 | 5/1938 | Gilliam | 62/105 |
| 2,443,203 | 6/1948 | Smith | 62/106 |
| 2,996,889 | 7/1961 | Roeder | 62/3 |
| 3,070,964 | 1/1963 | Horvay | 62/3 |
| 3,146,601 | 9/1964 | Gould | 62/3 |
| 3,167,925 | 2/1965 | Elfving | 62/3 |
| 3,175,369 | 3/1965 | Murphy et al. | 62/3 |
| 3,177,671 | 4/1965 | Stambaugh | 62/3 |
| 3,192,726 | 7/1965 | Newton | 62/3 |
| 3,194,023 | 7/1965 | Sudmeier | 62/3 |
| 3,195,315 | 7/1965 | Boehmer et al. | 62/3 |
| 3,200,600 | 8/1965 | Elfving | 62/3 |
| 3,214,922 | 11/1965 | Koblishek | 62/3 |
| 3,220,205 | 11/1965 | Breeding | 62/73 |
| 3,232,063 | 1/1966 | Eichhorn et al. | 62/3 |
| 3,232,064 | 2/1966 | Murphy et al. | 62/3 |
| 3,357,200 | 12/1967 | Connors | 62/349 |
| 3,423,949 | 1/1969 | Leeson et al. | 62/73 |
| 3,858,106 | 12/1974 | Launius | 321/45 R |
| 4,007,600 | 2/1977 | Simms | 62/3 |
| 4,055,053 | 10/1977 | Elfving et al. | 62/3 |
| 4,231,256 | 11/1980 | Chapman et al. | 73/421.5 R |
| 4,242,874 | 1/1981 | Simms | 62/3 |
| 4,248,259 | 2/1981 | Kaartinen et al. | 137/334 |
| 4,258,740 | 3/1981 | Kaartinen et al. | 137/74 |
| 4,297,850 | 11/1981 | Reed | 62/3 |
| 4,401,260 | 8/1983 | Grant | 49/334 X |

*Primary Examiner*—William E. Tapoical

*Attorney, Agent, or Firm*—Pollock, Vande Sande & Priddy

[57] ABSTRACT

The ice maker includes an ice mold in direct thermal communication with a thermoelectric refrigeration unit for freezing water contained in the mold. The mold and a harvest means for removing ice from the mold are in an insulated housing defining a cold storage bin for receiving harvested ice. The mold and refrigeration unit are mounted on the housing and a bottom wall of the housing comprises an insulated door with a closed position for supporting harvested ice and an open position for discharging harvested ice to a separable drawer for use. The door is mounted for rotation between open and closed positions and is rotated by a drive motor. The refrigeration unit includes a thermoelectric module in direct thermal communication with an external heat exchanger and the module may be sealed within an insulated wall of the housing. A locking mechanism may be provided to lock the dispensing door closed and a heat seal may be provided around the door.

22 Claims, 6 Drawing Figures

THERMOELECTRIC ICE CUBE MAKER

TECHNICAL FIELD

The field of this invention relates to thermoelectric ice makers and more particularly to a tamper resistant ice maker having relatively small physical dimensions to facilitate mounting the unit on the wall of a hotel or motel room or in a vehicle.

BACKGROUND OF THE INVENTION

Thermoelectric units have been used previously for refrigeration and for freezing water to make ice. Prior thermoelectric ice makers are exemplified by U.S. Pat. No. 3,192,726 to Newton and U.S. Pat. No. 4,055,053 to Elfing, et al., the entire contents of these patents being incorporated herein by reference. However, there has been a need for a thermal electric ice maker of more compact and durable construction for use in motel and hotel rooms and in vehicles of all types. An ice maker for these applications also needs to be of a tamper resistant construction to discourage contamination of stored ice.

Many ice making systems presently in use employ a conventional refrigeration system to cause freezing of water within compartments of an ice cube tray or mold. Unfortunately, conventional refrigeration systems employ compressors and evaporators for cooling refrigerant and are too large and cumbersome to permit their use in applications where space is at a premium. Conventional ice making systems also use relatively large storage bins as commonly found in hallways or central refreshment areas of hotels, motels and the like. Since only a portion of the accumulated ice is dipped out of such large bins by a succession of users, contamination of the remaining ice may occur through personal contact during removal of the desired portion. Since these large central bins are often unsecured and easily opened, there is also a risk of ice contamination by someone intentionally dumping trash or chemicals in with the accumulated ice.

Problems have also been experienced in the past with the use of thermoelectric assemblies for refrigeration in that cooling rates were low and condensation of moisture around thermocouples and the like caused deterioration of semiconductor materials and short circuiting of electrical terminals. The present invention includes features which overcome these disadvantages of the prior art.

DISCLOSURE OF THE INVENTION

A principal object of the present invention is to provide a compact ice maker having a sealed ice storage bin and automatic controls so that during freezing and storage the water and ice cannot be contaminated prior to being dispensed for use. Another object is to provide rapid manufacture and isolated storage of limited quantities of ice cubes at locations where space is at a premium and convenience is of prime importance.

The invention employs a miniaturized refrigeration system which relies upon an efficient thermoelectric module in direct contact with an ice mold for freezing water. The thermoelectric module is sealed against moisture penetration. The invention provides a compact ice cube maker of such reduced size as to permit personalized use of the ice maker in offices and hotel and motel rooms and in boats, airplanes, trucks, cars, trailers and other vehicles. After the ice is made it is stored in an insulated bin which is sealed to ensure that the ice cubes remain sanitary until dispensed for use. No physical contact with the ice cubes can occur until they are removed from the storage bin immediately prior to use. The ice maker includes a dispensing door which is tamper resistant and means for locking this door so as to substantially prevent the insertion of a hand or other contaminant means into the ice storage bin.

By the terms "thermoelectric module or unit" are meant any device employing the Peltier effect for heating or cooling. These devices are reversible in that heat can be selectively absorbed or released from the same side of the module by merely reversing the direction of current supplied to the module. Therefore either side of the device may be selected as the load side and the opposite side as the sink side. In this specification, the "load side" refers to the side attached to the ice making mold and the "sink side" refers to the side attached to a heat exchange means for dissipating to a heat exchange fluid the heat pumped from the load side to the sink side for cooling the mold so as to freeze liquid water contained in its water holding cavities.

The ice mold extends along one sidewall of the cold storage bin which comprises a chamber within an insulated enclosure or housing. The portion of the mold containing water holding cavities extends inwardly into an upper volume of the bin. The thermoelectric module is secured directly to an outer surface of the mold opposite from the water cavities. This surface extends vertically along a portion of the mold extending outwardly into the housing wall.

The vertically extending outer surface of the ice mold is in direct thermal communication with the load side of the thermoelectric module. The heat sink side of the thermoelectric module is in direct thermal communication with a heat exchange assembly for transferring heat to a vertically flowing heat exchange fluid. During a freeze cycle, current is supplied to the thermoelectric module in the direction that causes heat to be absorbed from the mold so as to freeze liquid water and form ice cubes in the mold cavities. In this specification, "ice cubes" refer to the bodies of ice formed in the mold cavities regardless of their actual shape, i.e., shapes other than cubical are within the scope of this disclosure. During a subsequent harvest cycle, current supplied to the thermoelectric module is reversed for a relatively short time and the mold is heated sufficiently to release or "free" the ice cubes from adherence to the walls of the mold cavities.

At about the same time that current is reversed, a harvest assembly comprised of projecting fingers on a rotatable shaft is actuated so that the fingers engage and push the ice cubes out of the mold cavities and into a storage volume within the cold storage bin. The ice making cavities and the harvest assembly are both contained within the cold storage bin defined by the insulated housing. The portion of the cold storage bin below the top of the mold cavities defines the cold storage volume for receiving ice removed from the cavities by the harvest assembly.

In a preferred embodiment, the housing is comprised of insulated wall sections each having a foamed plastic core surrounded by an outer casing of relatively dense plastic. The housing is preferably of molded construction and four of the wall sections, namely, a top wall and three sidewalls, are molded preferably as an integral unit.

A particularly important feature of the invention is that a section of the insulated housing, preferably at least a portion of its bottom wall and more preferably the entire bottom wall, comprises an insulated door mounted for rotation relative to the remainder of the housing. The door has a closed position for supporting ice discharged to the cold storage bin from the ice mold and an open position for discharging such accumulated ice from the cold storage bin into a recepticle for subsequent use.

The door is preferably arranged so as to rotate through at least 45° of arc in going from its closed position to its open position. More preferably, the door is mounted for rotation through a full 360° of arc relative to the remainder of the housing so that a first rotational movement of the door through at least about 180° of arc moves the door from a first closed position through an intermediate open position to a second closed position and a further rotational movement of the door through an additional arc of about 180° moves the door from the second closed position through an intermediate open position back to the first closed position. The door moves substantially continuously in going from one closed position to the next and is preferably held in its closed position by a locking mechanism when ice is not being dispensed so as to provide a relatively tamper resistant cold storage bin in which ice is stored until dispensed immediately prior to use. In other words, fresh ice is held within a sealed and insulated enclosure which does not have a readily accessible opening through which the accumulated ice could be handled or otherwise contaminated. When ice is needed for immediate use, it is dispensed into a use recepticle or drawer by activating a drive mechanism such as a motor for causing door rotation.

The drive mechanism for the door may comprise a mechanical hand crank or the like but preferably comprises a motor driven shaft with its rotational axis preferably coinciding with a central rotational axis of the door. Although the drive mechanism may cause a complete revolution of the door, partial revolutions may be employed using a movement reversal means such as a reversible motor. Where such reversal means is employed, the door may rotate through less than a full revolution (360° in one direction) such as through about 180° from one closed position to the next and then back again, or such as through about 90° from a closed to an open position and then back again. Due to the thickness of the insulated door, it should be rotated relative to the remainder of the housing through at least about 45° of arc so as to provide a sufficient opening for dispensing the ice. The door is preferably in substantially constant movement from one closed position to the next and moves relatively rapidly through its open position for dispensing ice so as to further reduce the chances of anyone contaminating the cold storage bin. Where the door is mounted for rotation through about 180° or less, its rotational axis may be offset relative to its central geometric axis.

A pivotably mounted arm for detecting the level of free ice within the storage bin is associated with the ice harvest assembly in conventional fashion. As the harvest fingers rotate to remove ice cubes from the ice mold, the level detection arm pivots up out of the way of the ice and then pivots down again after the ice has fallen into the cold storage bin. When the level of accumulated free ice cubes in the bin prevents the level detection arm from returning to its down (circuit closed) position, both the harvest assembly and the current reversal circuit are deactivated so that ice cubes no longer will be removed from the ice mold until accumulated ice in the cold storage bin is discharged through the dispensing door.

The dispensing door preferably includes sealing projections or lips around the door casing for engaging the adjacent portions of the insulated housing forming the door aperture. These lips form a heat seal between the edges of the door and adjacent edges of the door aperture when the door is in its closed position. The sealing lips preferably comprise a rib-like extension of the door casing and are preferably formed integrally with this casing. However, the door seals may comprise separate pieces fitted around each edge of the door and may be of a plastic or elastomeric material different from that of the door casing.

In a preferred embodiment of the invention, an uninsulated drawer is positioned below the cold storage bin so as to receive ice discharged from the bin through the dispensing door. Although the drawer may be insulated to preserve dispensed ice for longer periods, such insulation is often unnecessary because fresh ice will again be available from the cold storage bin after a relatively short period of time. Any insulation provided in or around this drawer does not form a part of the insulated housing enclosure previously described.

The invention preferably includes means for rendering the door actuator inoperative unless the drawer is in its position to receive ice discharged from the cold storage bin. This feature prevents dumping ice from the cold storage bin onto the floor or some other contaminated surface beneath the location at which the ice maker is installed. In this regard, the invention also preferably includes an uninsulated frame for mounting the insulated housing, the drawer and other ice maker components on the wall or on a counter within a motel room or the like.

The invention provides an improved control system for automatically operating the freezing, harvesting and refilling phases of the ice making cycle. Liquid water is first introduced into the cavities of the ice mold through a filling mechanism which may be actuated automatically in response to removal of previously made ice from the ice mold by the harvest assembly. The thermoelectric module is then actuated so as to freeze the individual bodies of liquid water to form ice cubes in the shape of the mold cavities. The control system preferably includes a thermostat in direct thermal communication with the ice mold. This thermostat closes or otherwise generates a signal in response to a preselected temperature indicating that the liquid water has been converted to ice. In response to this temperature signal, the control system causes actuation of the current reversal means so as to release the ice by heating the mold and actuation of the harvest means so as to push the freed ice from the mold. Upon removal from the mold, the freed ice falls into the cold storage volume of the bin as previously described. The emptied mold cavities are then refilled with liquid water and the current reversal means is deactivated so that current is again supplied to the thermoelectric module in the direction causing cooling of the mold and freezing of the next round of ice cubes.

When the cold storage bin is full of ice, the ice level arm detects this condition and provides a signal causing the control system to prevent further actuation of either the current reversal means or the harvest means. At this point in the operational sequence, a second thermostat mounted in thermal communication with the cold storage bin takes over and actuates a current controller which provides cyclical on-off operation of the thermoelectric module so as to maintain a preselected temperature range within the cold storage bin. This temperature range is selected so as to minimize energy consumption while maintaining ice cubes in a frozen condition both within the cold storage bin and within the ice forming cavities of the mold.

BRIEF DESCRIPTION OF THE DRAWINGS

The invention may be further understood by reference to the description below of its best mode and other embodiments taken in conjunction with the accompanying drawings in which:

FIG. 4 is a diagrammatic view illustrating installation of the invention on the wall of a bathroom in a motel, hotel or the like.

DESCRIPTION OF BEST MODE AND OTHER EMBODIMENTS

Figure 1:
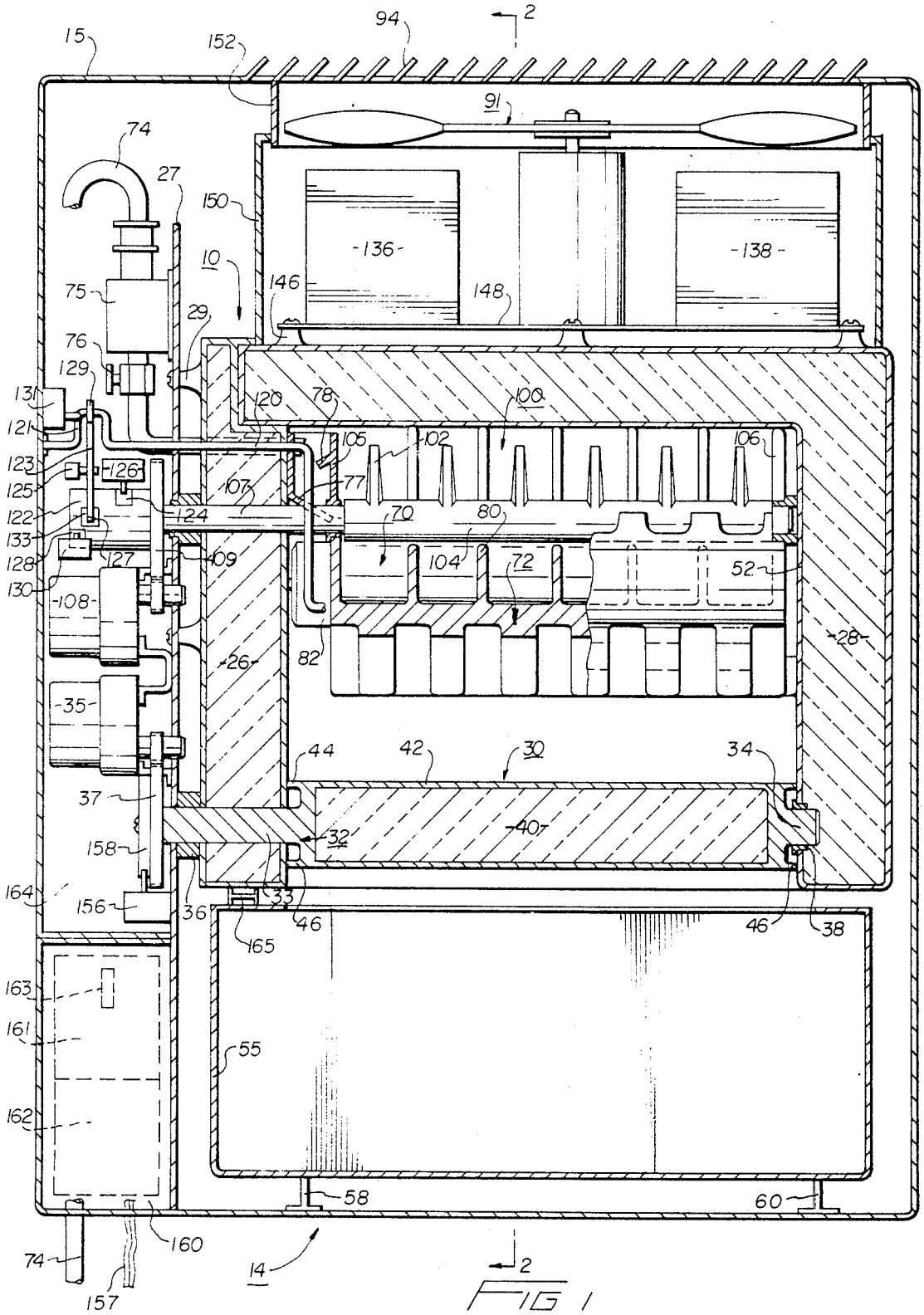
FIG. 1 is an elevational view of the invention from the rear as shown in section taken along lines 1—1 of FIG. 2.
Figure 2:
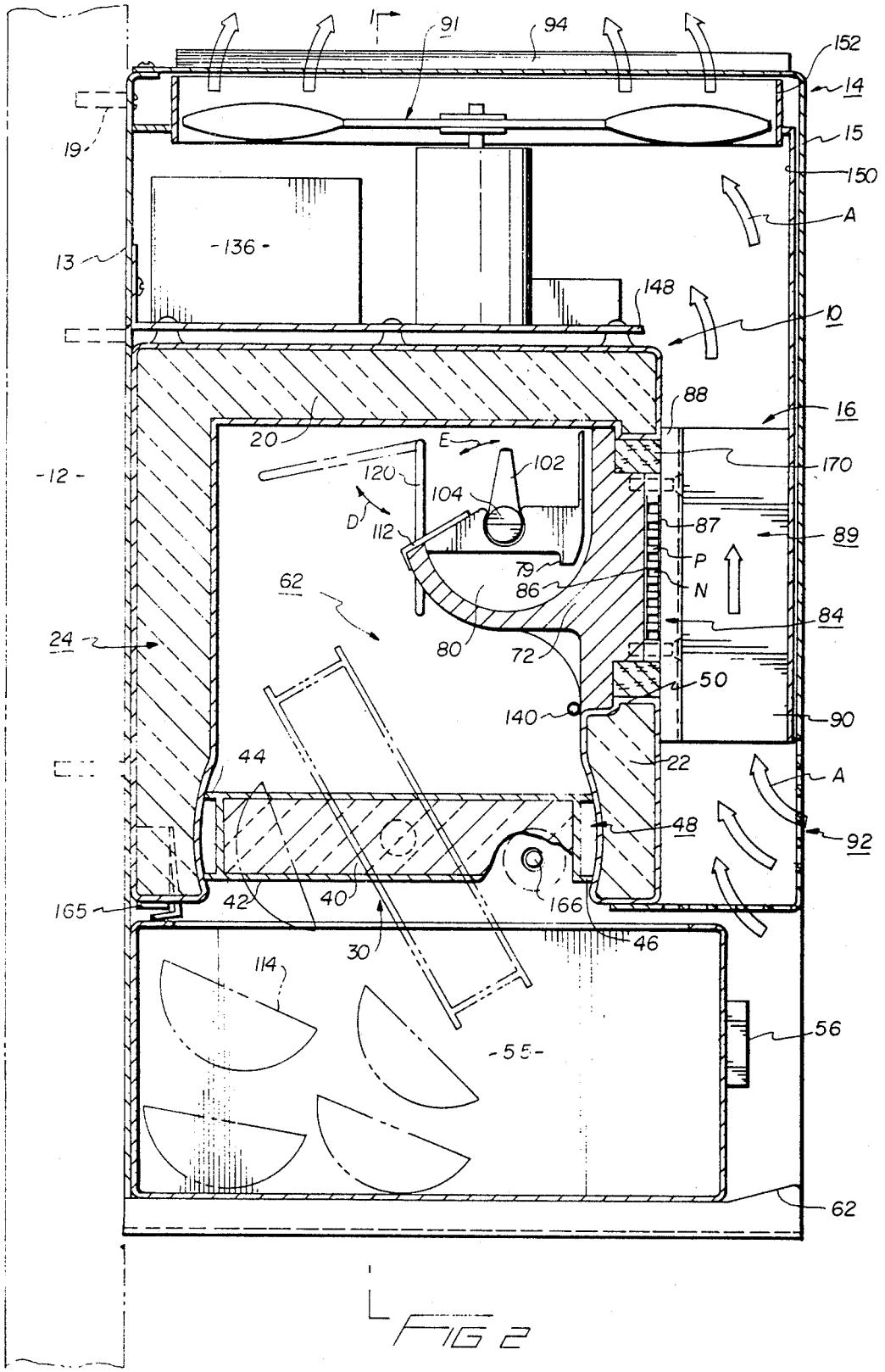
FIG. 2 is an elevational view of the invention from the side as shown in section taken along lines 2—2 of FIG. 1.
Figure 4:
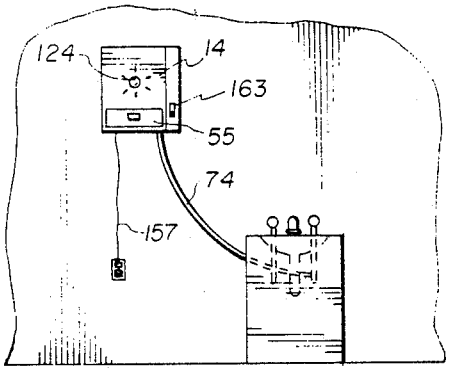

Referring to FIGS. 1 and 2 of the drawings, an insulated housing 10 is mounted on a supporting wall 12 by means of a frame 13 which comprises part of an uninsulated cabinet 14 having a decorative cover 15 enclosing all of the ice maker components hereinafter described. Mounted on insulated housing 10 is a refrigeration unit, generally designated 16. Frame 13 of ice maker cabinet 14 may be fastened by conventional wood screws 19 to wall 12 which may be located in the bathroom of a hotel or motel room. At this location, the ice maker may be connected to a standard 120 volt electrical wall outlet and to the cold water line of a bathroom sink as illustrated in FIG. 4.

Insulated housing 10 has a top wall 20, a front wall 22, a rear wall 24 and opposing sidewalls 26 and 28. The bottom wall of housing 10 comprises a door member 30 which is preferably mounted upon a shaft 32 for rotation through a full 360° of arc. Although shaft 32 may extend all of the way through the door interior, it is preferably comprised of two sections, namely, a drive shaft 33 secured to one sidewall of the door casing and a pin 34 secured to the opposite sidewall of the door casing as shown best in FIG. 1. Drive shaft 33 is rotatably supported by a bearing 36 and pin 34 is rotatably supported by a bearing 38. Drive shaft 33 is driven by a door motor 35 through a gear train 37.

Door 30 is preferably comprised of a plastic foam core 40 and a relatively dense outer plastic casing 42. Door 30 further includes a projecting ridge or sealing lip 44 extending all around the upper edge of the door and a similar sealing lip 46 extending all around the lower edge of the door. These projecting lips are relatively flexible and engage adjacent portions of the front, rear and side housing walls defining a door opening 48 so as to provide a thermal seal between each edge of the door and the door opening. The seals 44 and 46 are preferably extensions of the door casing 42 but may also be separate pieces extending along each edge of the door or part of a flexible covering around all or part of the door casing.

Each of the other walls of the insulated housing also preferably have a plastic foam core and an outer casing of relatively dense plastic similar to the construction of door 30. The wall sections are preferably molded from conventional plastic materials. The wall casing may be molded separately and then filled with an insulating foam. However, both the casing and the foam core are preferably of the same plastic material and are formed together as part of an integral molding process.

Although each section of the housing may comprise a separate panel, top wall 20, sidewall 28, front wall 22 and rear wall 24 are preferably molded as a single, integral housing unit. In this preferred embodiment, the equipment for driving dispensing door 30 and other movable components is mounted on a plate 27 secured by studs 29 to sidewall 26 such that this wall serves as an equipment panel permitting insertion and removal of the major ice maker components without disturbing the mounting frame or other walls of the insulated housing. With reference to FIG. 2, during insertion of sidewall 26 into its assembled position as part of the housing, refrigeration unit 16 slides along a slot 50 in front wall 22 until an outer end 52 of the refrigeration unit abuts sidewall 28. In assembling the insulated housing in this fashion, the ends of the shafting for rotating door 30 are slipped into their respective bearings as refrigeration unit 16 approaches its abutment with wall 28.

Carried beneath dispensing door 30, which forms the bottom wall of insulated housing 10, is a removable drawer 55 having a handle 56. This removable drawer slides in and out an a pair of runners 58 and 60 carried within a bottom portion of cabinet 14. Drawer runners 58 and 60 preferably have an upwardly extending seating pump 62 near the outer ends thereof so as to hold drawer 55 in proper position beneath dispensing door 30. The insulated walls of housing 10 define a cold storage bin 62 for holding and preserving ice made by refrigeration unit 16 as described below. Ice accumulating in bin 62 is then dispensed to drawer 55 by rotation of door 30 in a manner also to be described.

Referring to FIG. 1, liquid water is introduced into a series of cavities 70 in an ice mold 72 by water feed line 74 containing a solenoid valve 75 and a metering valve 76. Water from line 74 is distributed to the first of cavities 70 by a trough 77 containing an impact baffle 78. As seen best in FIG. 2, water entering the cavity adjacent to trough 77 flows to subsequent cavities through a slot 79 in a partition 80 between each cavity. Solenoid valve 75 is normally closed and is actuated to its open position for the length of time required to fill all of the cavities 70 to the desired level above the bottom of slot 79. Needle valve 76 is adjustable to regulate the water flow rate according to the pressure of the water supply to which the ice maker is connected.

A thermostat 82 is in direct thermal communication with mold 72 and forms part of an electrical system for supplying a direct current to a thermoelectric module 84 so that this module absorbs heat from ice mold 72 through a thin plate 86 on its load side and transfers this heat through a thin plate 87 on its sink side. Load plate 86 is in direct thermal communication with an adjacent vertically extending surface along an outer portion of ice mold 72 and sink plate 87 is in direct thermal communication with an adjacent, relatively thick base plate 88 of a heat exchanger assembly 89 having outwardly projecting heat exchange fins 90. A heat conductive grease is used around module 84 to ensure direct thermal contact of the module with the ice mold on one side and with the heat exchanger base plate on the other side. This direct thermal communication provides efficient heat removal so that the time required to convert liquid water to ice is minimized. When water temperatures are in the normal range, e.g., about 65° F. to 75° F., the time required for the ice maker to freeze a new batch of ice is only about 40 minutes or less.

Thermoelectric module 84 includes a plurality of alternating P and N type thermoelectric semi-conductor bodies P and N connected together in a conventional manner. One example of a commercially available thermoelectric module that can be employed satisfactorily in the present invention is model CP1.4-127-06 manufactured by Materials Electronic Products Corporation of Trenton, N.J. This is a low current, moderate capacity module suitable for use with a 12 volt DC current. The module contains 127 thermocouples, each of which is about 0.06 inches in length and about 1.4 mm square in cross-section. The thermoelectric material is a quaternary alloy of bismuth, tellurium, selenium, and antimony with small amounts of suitable dopants. This alloy is processed so as to produce an oriented polycrystalline ingot with anisotropic thermoelectric properties. The thermocouples are sandwiched between metalized ceramic plates affording good electrical insulation and thermal conduction.

Figure 3:
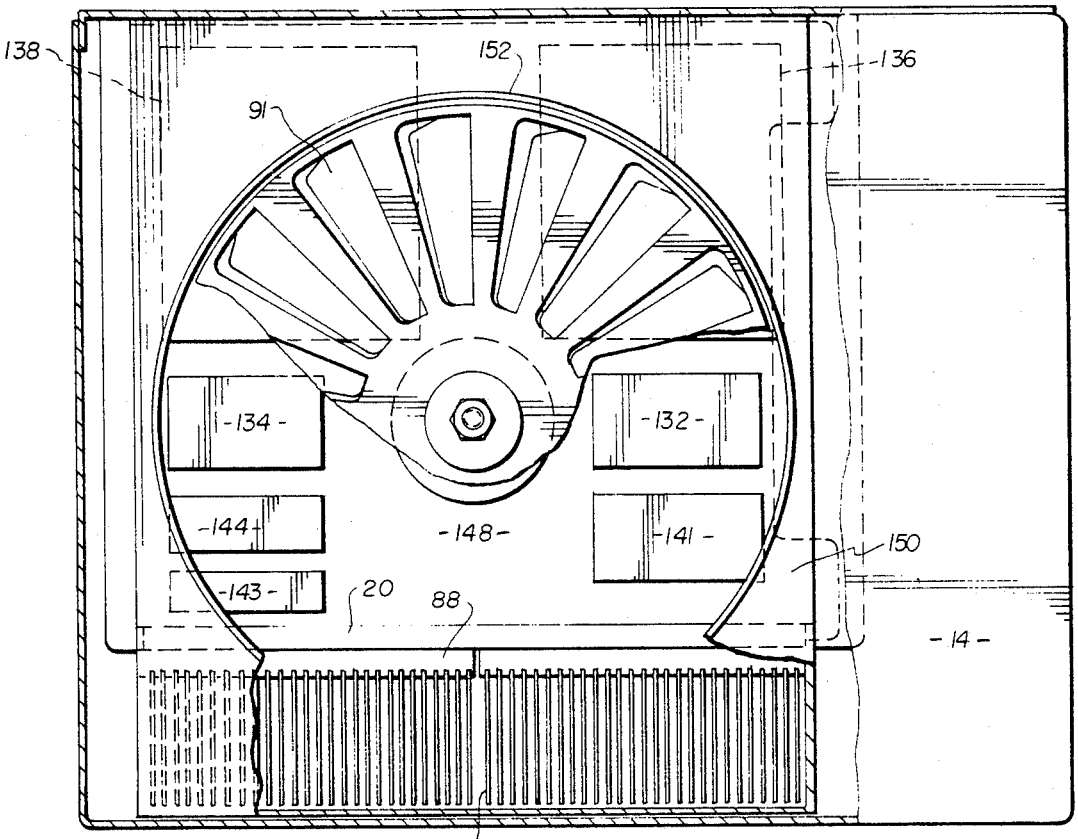
FIG. 3 is a plan view of the invention from the top as shown in partial sections.

During the time that cooling current is supplied to the thermoelectric module, a fan 91 operates continuously to pull air vertically past heat exchange fins 90 in the direction of arrows A so as to remove heat from heat exchanger 89 by forced air convection. For this purpose, cabinet cover 15 includes an air inlet grill 92 beneath the heat exchanger and air outlet louvers 94 overlying fan 91. To enhance air circulation within cover 15, there is preferably provided internal air ducting 150 which funnels heated air through an annular shroud 152 surrounding the blades of fan 91. Air ducting 150 is positioned closely adjacent to the sides of heat exchanger fins 90 as shown best in FIG. 3 so that substantially all fresh air must pass upwardly between the fins in order to be exhausted by fan 91.

Upon completion of the ice freezing cycle, ice cubes are removed from mold cavities 70 by a rotary harvester 100 having ice ejecting fingers 102 carried by a shaft 104 mounted at opposite ends for rotation in supporting brackets 105 and 106 carried by mold 72. The end of shaft 104 adjacent bracket 105 is connected to a drive shaft 107 which in turn is driven by a harvester motor 108 through a gear train 109.

With reference to FIG. 2, rotation of harvester fingers 102 in the direction of arrow E (counterclockwise in this view) causes the individual ice cubes formed in the mold cavities to be forced around and over shaft 104 where the ejected cubes then slide downwardly across an inclined plate 112 having slots larger than the width of the fingers but smaller than the width of the ejected ice cubes. Ice cubes 114 then fall to the bottom of storage bin 62 where they accumulate in a pile resting upon the upper surface of dispensing door 30.

Rotation of harvester shaft 104 through an initial arc of about 30° causes an ice level arm 120 to pivot from its full line position to its dotted line position as shown in FIG. 2, arm 120 being rotatably mounted on housing wall 26 so as to pivot back and forth in the direction of arrows D. With reference to FIG. 1, ice level arm 120 has a crank-like, U-shaped section 121 which is engaged between a pair of tines at a forked end 129 of a cam lever 123. Lever 123 is mounted for pivotal movement around a fulcrum member 125 in response to a cam follower end portion 127 riding on a cam 122. Pivotal movement of forked end 129 toward the front of the unit (into the page of FIG. 1) causes arm 120 to lift up out of the way of harvested ice cubes. The cam surface engaged by follower 127 is such that arm 120 remains up throughout most of the rotation of cam 38, i.e., from about 20°-40°, preferably about 30° until about 310°-340°, preferably about 320°. When arm 120 is in its lowered position, a bin switch 131 as shown in FIG. 1 is held in its closed position permitting initial actuation of harvester motor 108 upon the opening of thermostat 82. After initial upward movement of arm 120, bin switch 131 opens but by this time a hold switch 126 has been closed by cam 122 so as to keep harvester motor 108 activated throughout the rest of the harvesting cycle during which cam 122 rotates through a full 360° of arc. As shaft 104 approaches the completion of a full revolution (at about 320° of arc), ice level arm 120 is lowered back to its full line position unless bin 62 is full of ice.

The lowering of arm 120 resets bin switch 131 to its circuit closed position permitting further actuation of harvester motor 108 upon completion of the next freezing cycle. However, when the ice level arm is unable to return to its circuit closed position due to encountering the top of a pile of ice resting on door 30, the harvesting cycle is interrupted so that no further ice cubes are harvested until actuation of door 30 to dispense the accumulated ice. As shown in FIG. 4, there may be optionally provided a light 124 on the exterior of cabinet 14 which is activated when the ice level arm does not return to its circuit closing position so as to give a visual indication that the ice storage bin is full. A further optional provision is a relay (not shown) to prevent actuation of door 30 unless the light circuit is activated so as to prevent dispensing ice when the bin is only partially full.

The sequencing cam 122 carried by the outer end of harvester drive shaft 107 is a basic component of the control system for automatically programming the freezing and harvesting steps of the ice making cycle. Cam 122 includes a first cam surface 124 for operating hold switch 126, a second cam surface 128 for operating a water switch 130, and a third cam surface 133 for operating ice level arm 120 through lever 123.

With reference to the schematic diagram of FIG. 6, the sequence of automatic operation is as follows: upon detecting a temperature in the range of about 20° F. to about 30° F., preferably about 22° F. to about 26° F. and more preferably about 25° F., thermostat 82 closes and actuates a main relay 141 to shut off fan 91. Closure of thermostat 82 also causes actuation of a pair of current reversal relays 132 and 134 and activation of harvester motor 108, provided bin switch 131 is being held closed by arm 120. Actuation of current reversal relays 132 and 134 reverses the direction of current to thermoelectric module 84 so as to heat mold 72 and release the ice cubes from the walls of ice cavities 70. After about 10° of shaft rotation, cam 122 actuates hold switch 126 so as to keep relays 132 and 134 actuated and harvester motor 108 operating when bin switch 131 subsequently opens. After about 30° of rotation by harvester shaft 104 from its rest position where fingers 102 are approximately vertical as shown in FIG. 2, ice level bar 120 moves upward to its dotted line position opening bin switch 131 as previously explained.

After about 110° to 120° of shaft rotation, harvester fingers 102 engage the freed ice cubes. Harvester motor 108 is preferably of the stall type such that fingers 102 may come to rest and apply pressure against the ice cubes until such time as they are fully released by current flow to the thermoelectric module in the heat direction. As soon as the ice cubes are freed, shaft 104 continues to rotate in the direction of arrow E until it has completed a full 360° of rotation, at which time cam 122 deactivates hold switch 126 cutting off harvester motor 108.

At about 220° of harvester shaft rotation, sequence cam 122 actuates water switch 130 causing solenoid valve 75 to open so that water flows from feed water line 74 into ice cavities 70. Switch 130 then keeps solenoid valve 75 open while shaft 104 continues to rotate through an arc of about 70° to about 90°, the specific value in this range being selected to provide a proper water level in cavities 70. For example, solenoid valve 75 may remain open through about 80° of harvester shaft rotation with needle valve 76 being adjusted to provide the flow rate necessary to fill the ice cavities during this period. The period of time that solenoid valve 75 remains open depends on the time required for shaft 104 to rotate through about 80° of arc and this in turn depends on the speed of harvester motor 108 and the ratio of gear train 109. These are selected so that shaft 104 rotates preferably at about 1 revolution per minute.

The introduction of ambient temperature water into mold 72 raises the temperature of the mold body as detected by thermostat 82. When the temperature reaches a range of about 29° to about 32° F., preferably about 30° to about 31° F., thermostat 82 opens and deactuates main relay 141 so as to turn on fan 91 and deactuate current reversal relays 132 and 134 so that cooling current is again supplied to thermoelectric module 84. Current is supplied continuously to the thermoelectric module in one direction or the other as long as either bin switch 131 or hold switch 126 is closed.

The foregoing freezing and harvesting cycles continue until ice level arm 120 cannot return to its lowered position, thereby detecting that storage chamber 62 is full of ice. After ice level arm 120 indicates that bin 62 is full of ice by failing to close bin switch 131, a controller 142 intermittently actuates relay 141 so as to convert thermoelectric module 84 and fan 91 to intermittent cooling operation in response to a bin thermostat 140 located adjacent to the internal bottom edge of ice mold 72 as shown in FIG. 2. Bin thermostat 140 is preferably set so as to activate a cooling cycle at a temperature in the range of preferably about 30° F. to about 31° F. and to deactivate this cycle so as to turn off thermoelectric module 84 and fan 91 when the bin temperature is lowered to preferably about 25° F to 26° F.

During cyclic operation of the freezing unit with bin 62 full of ice, fan 91 is preferably activated only during the periods that cooling current is supplied to the thermoelectric module. The fan is preferably shut off at all other times to save energy consumption. On the other hand, the thermoelectric module and the heat removal fan are operated continuously during the freezing portion of the ice making cycle when the ice level arm is in its circuit closing position against bin switch 131. Continuous operation of these components in their freezing mode is capable of rapidly providing a supply of new ice as explained above.

Storage chamber 62 is preferably sized so as to be filled by preferably 1 to 3, more preferably 2, batches of ice from the ice mold 72. Since one batch of ice may be formed in about 40 minutes, this is the minimum time required to fill bin 62 where the bin is sized for two batches and the ice mold already contains a third batch ready to be harvested at the time freed ice is dispensed by door 30. Should ice be dispensed again just after the ice mold has been filled with liquid water, approximately 80 minutes would be required to again fill the ice bin, i.e., the time required for two complete freezing and harvesting cycles.

Figure 6:
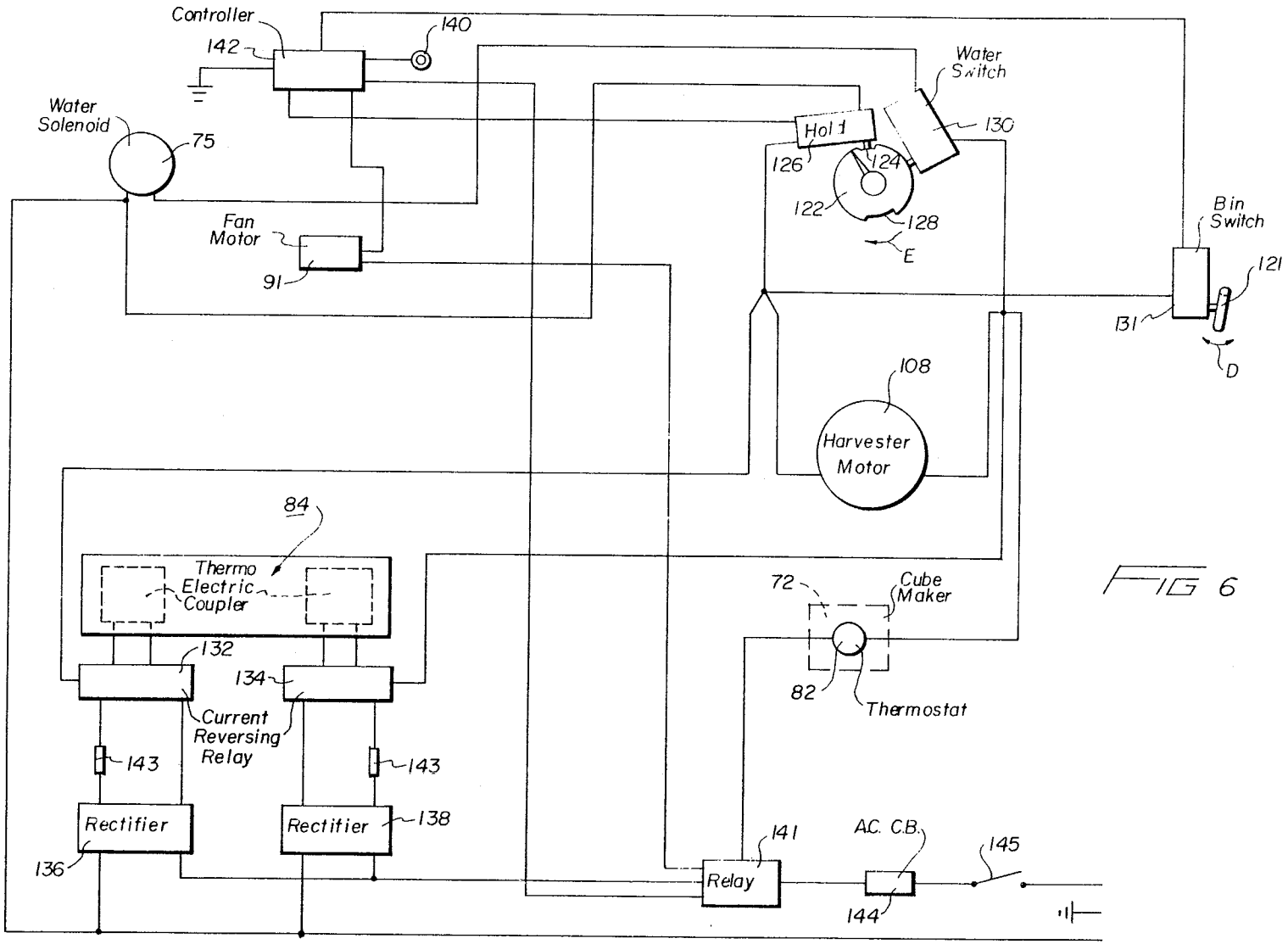
FIG. 6 is a diagrammatic view illustrating a suitable electric circuit for providing power to and control of electrical components of the invention.

Referring again to the electrical schematic diagram of FIG. 6, the electrical control circuit also includes a pair of AC to DC current rectifiers 136 and 138, a pair of DC fuses 143, an AC circuit breaker 144, and an on-off main switch 145. Fan 91, rectifiers 136 and 138, relays 132, 134 and 141, fuses 143 and circuit breaker 144 are preferably mounted on an equipment tray 148 separated from top wall 20 of the insulated housing 10 by stud mounts 146 which provide an air space to reduce the transfer of heat energy from equipment on tray 148 to the insulated housing walls. Equipment plate 27 mounted on sidewall 26 performs a similar function.

Preferably cabinet cover 15 and insulated housing sidewall 26 are removable so as to provide easy access to the mechanical equipment and electrical components of the ice maker for purposes of maintenance and/or replacement without having to remove cabinet 14 from its wall mounting.

Figure 5:
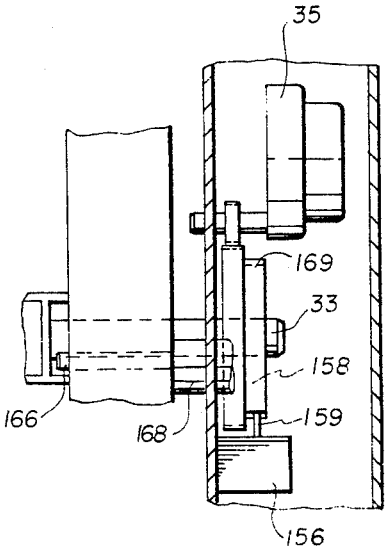
FIG. 5 is a fragmentary front elevational view shown in partial section and illustrating a mechanism for locking closed the dispensing door of the insulated ice storage bin.

With reference to FIG. 5, the operating mechanism for dispensing door 30 preferably includes a biased open hold switch 156 actuated by a cam 158 carried by door drive shaft 33. Door motor 35 may be actuated by coin operated switch 161 housed within a coin box 162 carried within a switch chamber 160 located beneath a main equipment chamber 164 which extends vertically within one side of cabinet 14 as shown in FIG. 1. Switch 161 instead may comprise a simple button type or key operated manual switch on the exterior of cabinet 14. The power supply and components for this switch also may be housed in switch chamber 160. Switch 161, as well as the other electrical components of the ice maker, is connected preferably to a standard 120 volt electrical outlet by an electric cord 157. Insertion of a coin into coin switch 161 through a coin slot 163 in the front wall of cabinet 14, or the closure of an alternate type of button or key operated switch, initiates actuation of door motor 35, which in turn rotates cam 158 so that a follower button rides out of a first detent 159 and closes switch 156. Switch 161 includes a time delay mechanism (not shown) so that cam 158 can rotate by an amount sufficient to close switch 156 during the time delay period. Switch 156 keeps the circuit to motor 35 closed until door 30 rotates through about 180°, at which point a second cam detent 169 allows switch 156 to open, shutting off door motor 35.

The circuit supplying electrical power to door motor 35 also preferably includes an interlock switch 165 which is biased open but is held closed by drawer 55 as shown in FIG. 2. Switch 165 therefore prevents actuation of motor 35 unless drawer 55 is in position to receive the ice cubes to be dispensed by rotation of door 30.

There is also shown in FIG. 5 one means of locking dispensing door 30 in its closed position so as to improve the tamper resistant nature of ice storage chamber 62 within insulated housing 10. The door locking means comprises an inwardly biased reciprocating locking pin 166 which is actuated to its retracted position by a solenoid 168. As long as switch 156 remains closed, solenoid 168 holds pin 166 in its retracted (unlocked) position so that door 30 may rotate around its axis as illustrated in dotted outline in FIG. 2. Door rotation dumps accumulated ice resting on door 30 to drawer 55. Upon completing rotation through 180°, door 30 is brought to rest by the opening of switch 156 and simultaneously is locked into this second closed position by extension of pin 166 which reciprocates inward to the position shown in FIG. 5 upon deactivation of solenoid 168. In other words, pin 166 is normally biased toward its extended (locked) position by a spring (not shown) and is retracted to its unlocked position against the bias of this spring upon actuation of solenoid 168 by closure of switch 156.

A particularly important feature of the invention is that thermoelectric module 84 is sealed against moisture so as to prevent deterioration and/or short circuiting of the thermocouples by exposure to water. Referring to FIG. 2, the thermoelectric module is surrounded on all four edges by an annular gasket 170 of a water impermeable, compressible material, such as cork or an elastomeric material. This cork gasket is preferably coated with a silicone sealant so as to further isolate the thermal electric module from moisture. When freezing unit 16 is mounted on housing wall 22, base plate 88 of heat exchanger assembly 89 is tightened against the outer casing of wall 22 so as to compress the cork annulus. This compressive and sealing action is provided by means of mounting screws 172 which are threaded into the vertically extending outer wall of ice mold 72 as illustrated in FIG. 2. In addition, the outer surfaces of plates 86 and 87 on each side of the thermoelectric module itself are coated with a thermal grease that helps seal the module against moisture and also facilitates thermal communication between the load side of the module and the ice mold and between the sink side of the module and the heat exchanger.

INDUSTRIAL APPLICABILITY

The present invention employs a miniaturized refrigeration system which relies upon an efficient thermoelectric module in direct contact with an ice cube mold for freezing water. The thermoelectric module and other features of the invention provide a compact ice cube maker of such reduced size as to permit personalized use of the ice maker in offices and hotel and motel rooms and in boats, airplanes, trucks, cars, trailers and other vehicles. After the ice is made, it is stored in an insulated bin which is locked and sealed to ensure that the ice cubes remain sanitary until dispensed for use. Both the ice cube mold and a heat exchanger assembly cooperate with the thermoelectric module so as to ensure an efficient pumping of heat from water in the ice cube cavities to a heat exchange fluid flowing past heat exchanger fins. The cooling and heating efficiency of the thermoelectric module is optimized by direct attachment of its load side to the ice mold and direct attachment of its sink side to the heat exchanger assembly. Rapid heat dissipation is provided by a large fin surface area and a large diameter cooling fan for rapidly moving air past vertically extending fins of the heat exchanger.

A relatively brief reversal of current through the thermoelectric module provides rapid release of the ice cubes from the walls of the mold cavities so that the ice may be forced out easily by the fingers of a rotary harvester. The relationship between the rotary harvester and the ice mold is such as to minimize the space requirements for these components within the insulated ice bin. A rotary dispensing door provides a tamper resistant means for discharging accumulated ice from the ice bin. An interlock switch prevents actuation of the dispensing door unless an ice receiving drawer is in position beneath the door. When the drawer is removed for distributing the dispensed ice cubes, the rotary door cannot be actuated in order to avoid dumping ice onto the floor while the drawer is out and to prevent the entry of hands and the like into the ice bin. The insulated housing defining the ice bin is mounted on a frame which may have a decorative cover and fasteners for mounting the frame on a wall. The ice making unit may be connected by conventional means to an existing water conduit, such as the cold water line to a sink, and to a standard electrical wall outlet.

What is claimed is:

1. An ice making apparatus comprising:

mold means for holding a body of liquid water;

thermoelectric means for freezing at least a portion of said body of liquid water so as to form ice in said mold means;

harvest means for removing said ice from said mold means;

an insulated housing containing said mold means and said harvest means and defining a cold storage bin for receiving said ice upon its removal from said mold means by said harvest means;

said insulated housing including an insulated door having a closed position for supporting said removed ice as it accumulates in said cold storage bin and an open position for discharging said accumulated ice from said cold storage bin;

control means for preventing removal of said ice from said mold means by said harvest means when said cold storage bin is full of said accumulated ice; and, drive means for causing said insulated door to move between said closed position and said open position so as to discharge said accumulated ice from said cold storage bin.

2. The apparatus of claim 1 in which said door is mounted for rotation relative to the remainder of said housing so as to rotate through at least about 45° of arc in going from said closed position to said open position.

3. The apparatus of claim 1 in which said door is mounted for rotation through at least about 180° of arc relative to the remainder of said housing and cooperates with the remainder of said housing such that said rotation moves said door from a first closed position through an intermediate open position to a second closed position.

4. The apparatus of claim 3 in which said door is mounted for rotation through a full 360° of arc relative to the remainder of said housing, the rotation of said door from about 180° of arc to about 360° of arc causing said door to move from said second closed position to said first closed position through a second intermediate open position.

5. The apparatus of claim 1 in which said door includes seal means for engaging a door opening formed by adjacent portions of the remainder of said insulated housing so as to form a heat seal between the edges of said door and said adjacent housing portions when said door is in said closed position.

6. The apparatus of claim 1 in which said insulated housing is of molded plastic and the wall(s) of said housing comprises a foamed plastic core surrounded by an outer casing of relatively dense plastic.

7. The apparatus of claim 6 in which said insulated housing further includes at least four wall segments molded as an integral unit.

8. The apparatus of claim 1 in which said insulated housing has a bottom wall and said door forms at least a portion of said bottom wall.

9. The apparatus of claim 1 which further includes a drawer positioned below said cold storage bin so as to receive ice discharged from said cold storage bin through said door.

10. The apparatus of claim 9 which further includes means for preventing movement of said door by said drive means unless said drawer is in a position to receive ice discharged from said cold storage bin.

11. The apparatus of claim 9 in which said drawer is positioned under at least a portion of said door.

12. The apparatus of claim 1 in which said mold means is of heat conductive material and has at least one vertically extending heat transfer surface and said thermoelectric means comprises a thermoelectric module with a load side and a heat sink side, said load side being in direct thermal communication with said heat transfer surface and said heat sink side being in direct thermal communication with a heat exchange means for transferring heat to a vertically flowing heat exchange medium.

13. The apparatus of claim 1 which further includes current reversal means for changing the direction of current through said thermoelectric means such that current in one direction cools said mold so as to freeze said body of liquid water to form ice and current in another direction heats said mold so as to free said ice from said mold prior to removal of said ice by said harvest means.

14. The apparatus of claim 13 which further includes control means for causing actuation of said current reversal means so as to free said ice and actuation of said harvest means so as to remove said freed ice from said mold when the temperature of said mold reaches a preselected temperature below the freezing point of water.

15. The apparatus of claim 14 in which said control means includes a thermostat in thermal communication with said mold, said thermostat generating a signal in response to a preselected temperature below the freezing point of water.

16. The apparatus of claim 14 in which said mold means includes at least one cavity for holding liquid water, and said apparatus further includes fill means for introducing liquid water into said at least one cavity.

17. The apparatus of claim 16 in which said control means includes means for causing said fill means to introduce said liquid water into said at least one cavity and for causing actuation of said current reversal means so as to freeze said body of liquid water to form ice after removal of previously made ice from said mold means by said harvest means.

18. The apparatus of claim 1 in which said door is mounted for rotation through at least about 180° of arc relative to the remainder of said housing and cooperates with the remainder of said housing such that rotation of said door in one direction moves said door from a first closed position through an intermediate open position to a second closed position and rotation of said door in an opposite direction moves said door from said second closed position through said intermediate open position back to said first closed position.

19. The apparatus of claim 1 which further includes locking means for holding said door in said closed position until activation of said drive means so as to cause said insulated door to move between said closed position and said open position.

20. An ice making apparatus comprising:

mold means for holding a body of liquid water;

thermoelectric means for freezing at least a portion of said body of liquid water so as to form ice in said mold means;

harvest means for removing said ice from said mold means;

an insulated housing containing said mold means and said harvest means and defining a cold storage bin for receiving ice removed from said mold means by said harvest means;

said insulated housing including an insulated door having a closed position for supporting ice accumulating in said cold storage bin and an open position for discharging said accumulated ice from said cold storage bin;

drive means for causing said insulated door to move between said closed position and said open position so as to discharge said accumulated ice from said cold storage bin; and, locking means for holding said door in said closed position until activation of said drive means so as to cause said insulated door to move between said closed position and said open position.

21. An ice making apparatus comprising:

mold means for holding a body of liquid water;

thermoelectric means for freezing at least a portion of said body of liquid water so as to form ice in said mold means;

harvest means for removing said ice from said mold means;

an insulated housing containing said mold means and said harvest means and defining a cold storage bin for receiving ice removed from said mold means by said harvest means;

said insulated housing including an insulated door having a closed position for supporting ice accumulating in said cold storage bin and an open position for discharging said accumulated ice from said cold storage bin;

drive means for causing said insulated door to move between said closed position and said open position so as to discharge said accumulated ice from said cold storage bin; and, a drawer positioned outside of said insulated housing and below said cold storage bin so as to receive ice discharged from said cold storage bin when said insulated door is in said open position.

22. The apparatus of claim 21 which further includes means for preventing movement of said door by said drive means unless said drawer is in position to receive ice discharged from said cold storage bin, and in which said drawer is removable from said position so as to serve as a portable carrier for said discharged ice.

* * * * *